US006698129B1

(12) United States Patent
Hanks

(10) Patent No.: US 6,698,129 B1
(45) Date of Patent: Mar. 2, 2004

(54) REPLACEMENT AMMUNITION CLIP FOR A WEAPON

(76) Inventor: Timothy C. Hanks, 5145 Ranier Pass, Columbia Heights, MN (US) 55421

( * ) Notice: Subject to any disclaimer, the term of this patent is extended or adjusted under 35 U.S.C. 154(b) by 0 days.

(21) Appl. No.: 10/261,424

(22) Filed: Sep. 30, 2002

(51) Int. Cl.[7] ..... F41C 27/00
(52) U.S. Cl. ..... 42/90
(58) Field of Search ..... 42/90, 124

(56) References Cited

U.S. PATENT DOCUMENTS 4,100,694 A * 7/1978 Musgrave ..... 42/90
4,115,943 A * 9/1978 Musgrave ..... 42/90
4,442,962 A * 4/1984 Musgrave ..... 224/255
4,484,404 A * 11/1984 Johnson ..... 42/90
4,597,213 A * 7/1986 Musgrave ..... 42/90
4,628,627 A * 12/1986 Johnson ..... 42/90
4,685,238 A * 8/1987 Schoepflin ..... 42/90
4,799,323 A * 1/1989 Musgrave ..... 42/90
4,876,815 A * 10/1989 Terrill ..... 42/139
5,121,564 A * 6/1992 Story ..... 42/90
5,279,059 A * 1/1994 Howard ..... 42/90
5,319,872 A * 6/1994 Bammate ..... 42/88
5,584,137 A * 12/1996 Teetzel ..... 42/117
5,636,465 A * 6/1997 Johnson ..... 42/90
6,154,997 A * 12/2000 Aluotto et al. ..... 42/90
6,327,805 B1 * 12/2001 Clifton, Jr. ..... 42/90
6,508,027 B1 * 1/2003 Kim ..... 42/124

* cited by examiner

*Primary Examiner*—Michael J. Carone
*Assistant Examiner*—Denise J Buckley
(74) *Attorney, Agent, or Firm*—Nawrocki, Rooney & Sivertson, P.A.

(57) ABSTRACT

The present invention includes an apparatus for unobtrusively disposing a replacement clip for an automatic weapon having a magazine well into which a clip is received. The apparatus is constructed and arranged to provide facile and expeditious insertion of a clip into the magazine well. The apparatus includes a sheath and mechanism for mounting the sheath to an automatic weapon. The sheath includes a structure for carrying the replacement clip including a dispensing port through which the replacement clip is withdrawn. The mechanism for mounting is positioned wherein a replacement clip carried within the sheath is fully withdrawn along an axis of the sheath, the clip is oriented and located relative to an entry to the magazine well to enable prompt insertion therein.

8 Claims, 8 Drawing Sheets

REPLACEMENT AMMUNITION CLIP FOR A WEAPON

TECHNICAL FIELD

The present invention deals broadly with the field of weapons. More specifically, the invention is related to storage structures for replacement ammunition clips.

BACKGROUND OF THE INVENTION

In the field of automatic weapons, emphasis is placed upon the quantity of rounds that can be fired from the weapon. In these weapons, a clip has been developed to hold a plurality of bullets and is designed to allow the bullets to be loaded in the firing chamber of the weapon in rapid succession. However, generally a clip, holding the ammunition, only holds a small number of bullets and, therefore, it is necessary to reload the weapon from time to time, by removing the empty magazine clip from the magazine well of the weapon and inserting a replacement clip. Since the user of the weapon cannot fire multiple rounds during the reloading process, it is of utmost importance that the reloading process be done as quickly as possible.

Traditionally, the removal of the empty clip had to be done by holding the weapon with one hand and removing the empty magazine clip with the other hand. Many weapons today have mechanisms that, when a button is depressed, expel the magazine clip through use of a spring mechanism thereby allowing the holder of the weapon to hold the weapon with one hand and use the other hand to obtain a replacement clip. Although this innovation has sped up the process of reloading the weapon, the replacement clips are not positioned for quick insertion. For example, replacement clips are typically stored for use in either a pouch or sheath positioned far from the magazine well, or attached to the magazine clip.

Typically, the pouch encloses one or more clips together and typically has a strap that can be placed over the arm or shoulder of the user of the weapon or may be attached to the weapon itself. The pouch apparatus generally requires two hands to use and, therefore, is difficult to utilize when holding the weapon.

Sheaths, as known in the prior art, generally have a receiver for holding a portion of one or more clips while having a portion of each clip exposed, allowing the user to grasp the exposed portion. Sheaths are constructed for attachment to the user, or the weapon, by either a strap or a belt. Straps allow the sheath to be hung over the user's shoulder, while belts allow the sheath to be positioned around a body part of the user or the butt stock of the weapon. Common positioning of sheaths is around the waist, or thigh of the user. The means for attaching a sheath to the butt stock of a weapon are typically VELCRO hook and loop fasteners. Although the sheath allows for the user to grasp the clip with one hand while holding the weapon with the other, the location of the clip is typically not in close proximity to the magazine well of the weapon into which the magazine clip is expelled and the replacement clip is inserted.

Weapon users have also attempted to solve this problem by attaching two clips together. Oftentimes this method has been accomplished by simply duct taping the two clips together, however, special brackets have been made to connect two clips together. These methods allow the user to easily release the magazine clip and move the replacement clip into position. However, in some applications it may be advantageous to have the magazine clip expelled from the weapon without having it connected to the replacement clip.

Accordingly, there is a need in the art for an apparatus that attaches a replacement clip in a position on the weapon that is convenient for the user to grasp, that unobtrusively positions the clip in proximity to the magazine well, and can be oriented for facile and expeditious insertion into the well.

SUMMARY OF THE INVENTION

The present invention provides an apparatus for unobtrusively disposing a replacement clip for an automatic weapon having a magazine well into which a clip is received. The apparatus includes a sheath and mechanism for mounting the sheath to an automatic weapon.

The sheath includes a structure for carrying the replacement clip including a dispensing port through which the replacement clip is withdrawn. The mechanism for mounting is positioned wherein a replacement clip carried within the sheath is fully withdrawn along an axis of the sheath, the clip is oriented and located relative to an entry to the magazine well to enable prompt insertion therein.

The apparatus of the present invention is particularly useful with weapons having a rail structure for mounting accessories thereon. These rail structures are oftentimes used on rifles and are typically mounted along the elongated barrel of the weapon. The rail is often comprised having a plurality of slots formed transversely thereon in relation to the elongate axis of the rail. In this embodiment, a clamp may be utilized to mount the sheath to the rail structure thereby capturing a portion of the rail between the jaws of the clamp. It is preferred that the jaws be adjustable toward and away from one another for capturing the rail. The rail is generally captured between the jaws such that the inner surface of the jaws are in contact with the outer surface of the rail. It is preferred that the axis along which the jaws move toward and away from one another can be varied relative to the orientation of the axis of the sheath. In this way, the angle of the opening of the sheath can be changed with respect to the angle of the axis the jaws move.

It is also preferred that, when mounted, the central axis of the dispensing port be angled to the elongate axis of the rail.

Further, embodiments of the present invention may also have an elongate connection member, such as a screw or bolt that spans between the two jaws. The elongate connection member attaches the two jaws together and may also provide the adjustment mechanism for moving the jaws. The elongate connection member may be utilized to help hold the sheath in place by spanning the jaws of the clamp within one of the slots. When a screw or bolt is utilized, an aperture is formed in one jaw having a threaded interior and another aperture is formed in the other jaw having a non-threaded interior. The threaded exterior of the screw or bolt is then placed through the non-threaded aperture and threaded into the threaded aperture.

The interior of the sheath is sized to frictionally hold the clip in the sheath. Additionally, a roller may be mounted within the interior space of the sheath to aid in the movement of the clip received therein.

Other structures and advantages of the present invention will be readily appreciated in view of the accompanying drawings and detailed description provided.

DESCRIPTION OF THE PREFERRED EMBODIMENTS

Figure 1:
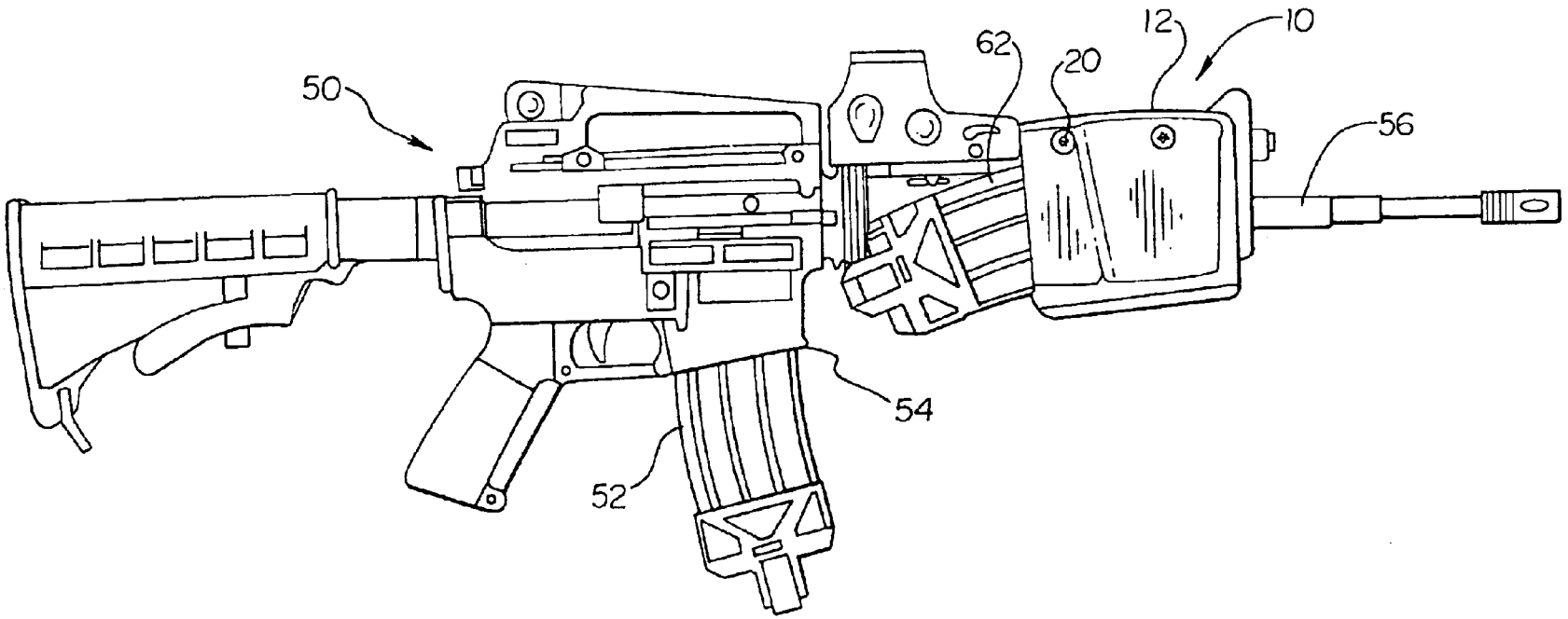
FIG. 1 is a right side view of an embodiment of the present invention attached to an assault rifle.

One embodiment of the present invention is shown in FIG. 1 mounted to a weapon 50. An apparatus 10 for disposing a replacement clip 52 for an automatic weapon 50 having a magazine well 54 into which a clip 52 is received. The weapon 50 includes a barrel 56 and a rail 58 mounted to the barrel 56.

Figure 2:
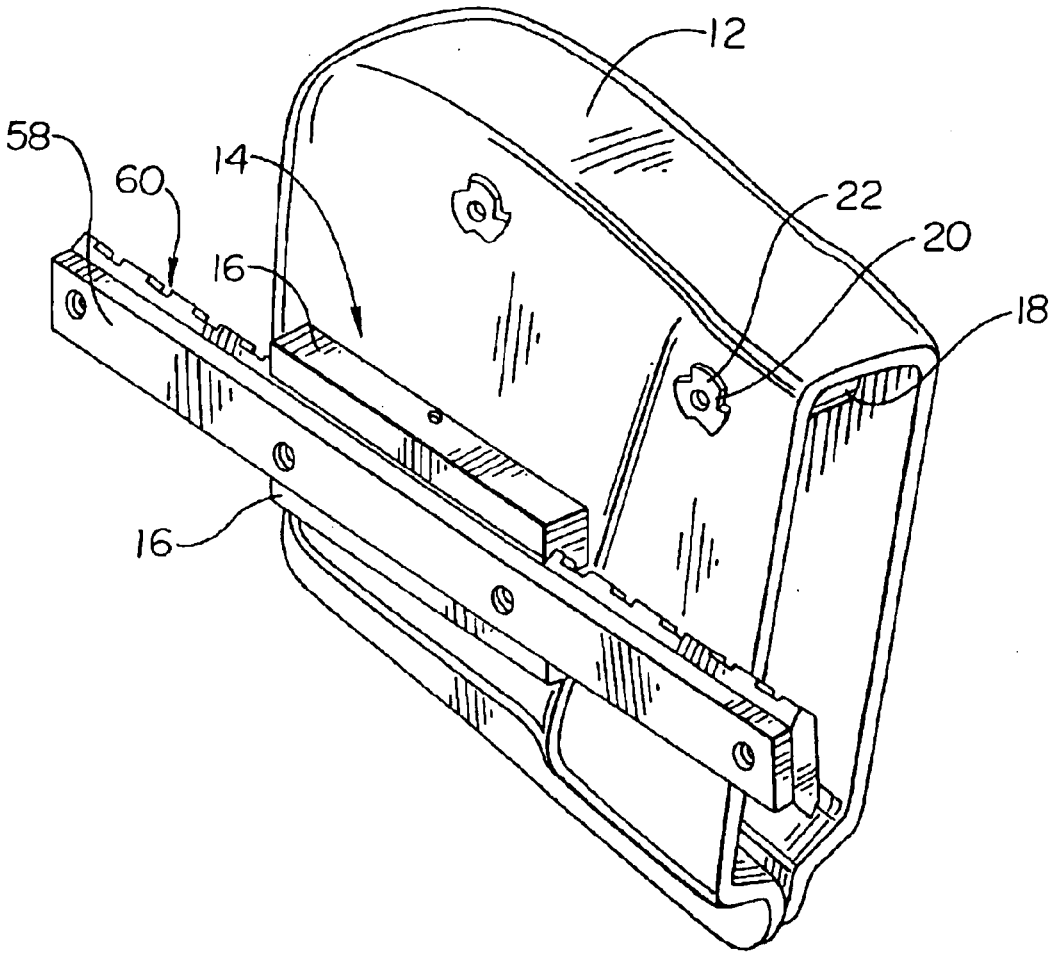
FIG. 2 is an angled left side perspective view of an embodiment of the present invention, shown with a standard mounting rail for a weapon mounted within the jaws of the embodiment.
Figure 3:
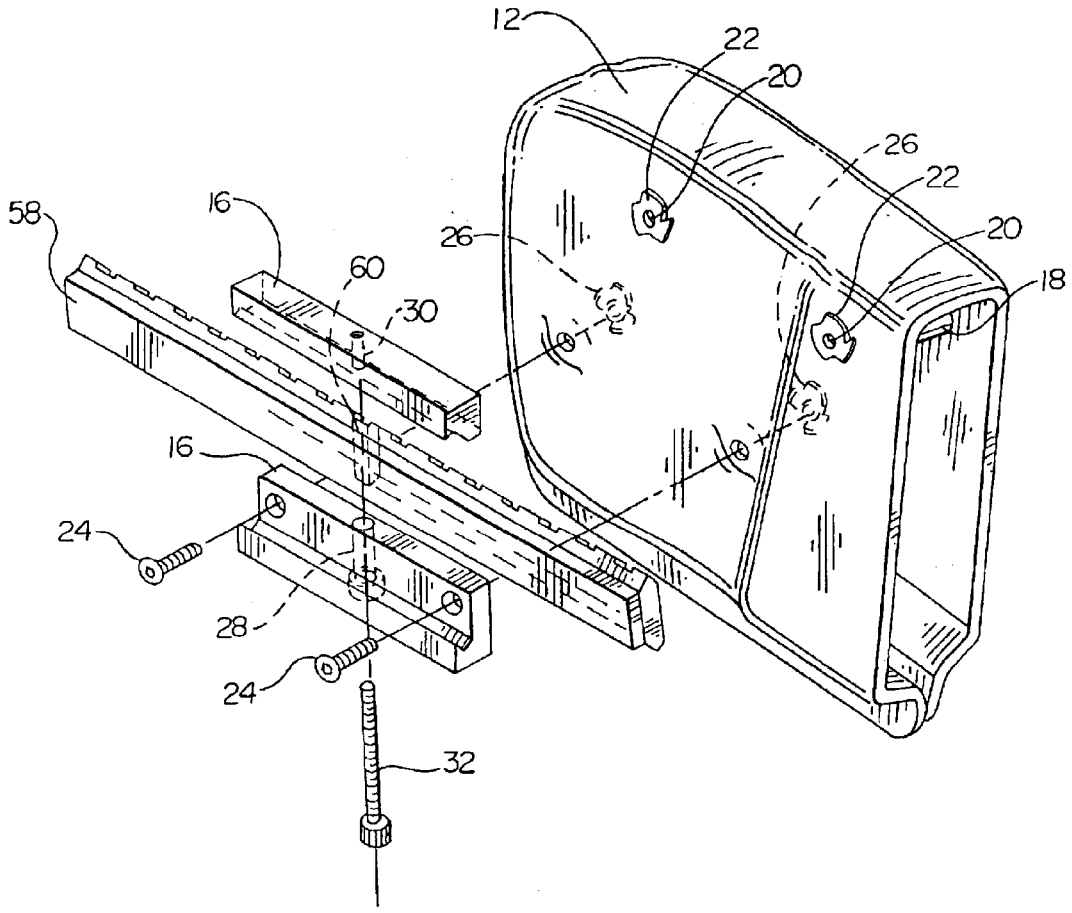
FIG. 3 is an exploded view of the embodiment shown in FIG. 2.

As shown in FIG. 2, the apparatus 10 includes a sheath 12 and mechanism for mounting the sheath 12 to the rail 58 of an automatic weapon 50. In FIGS. 2 and 3, the rail 58 has been removed from the weapon 50 to show how the attachment of this embodiment is accomplished. As shown, in this embodiment, the mechanism is a clamp 14 having a pair of jaws 16 the jaws preferably have an interior surface shape that matches the exterior surface shape of the rail 58. In this way, the jaws 16 of the clamp 14 can provide better frictional force due to the added surface area in contact with the rail 58. Rails typically utilized include Picatinny and Weaver styles, although any rail and/or generally fixed mounting system may be utilized with the present invention.

The sheath 12 may be fabricated from any material known in the art. Such suitable materials include plastic, leather, synthetic fabrics, and the like. The embodiment shown in FIG. 2 is comprised of a single piece of plastic material. The embodiment of the sheath 12 also includes two rollers 18 that are attached to the sheath 12 by screws 20 and anchors 22. The use of these screws 20 and anchors 22 can also aid in maintaining the interior dimension of the sheath 12. In this way, when a clip 52 is placed therein, the walls of the sheath 12 will not move as much and, therefore, the sheath 12 can provide more frictional force to hold the clip 52 in place. The mounting mechanism, shown in the figures as clamp 14, can be mounted to the sheath by any means known in the art, for example by screws 24 and anchors 26.

FIG. 3 shows one embodiment illustrating the structure of a clamp 14 as may be employed in the attachment of the sheath 12 to a weapon 50. In this embodiment, a non-threaded aperture 28 is formed in one of the jaws 16, and a threaded aperture 30 is formed in the other jaw 16. An elongate connection member 32, such as a screw or bolt having complimentary exterior threading, may be passed through the non-threaded aperture 28 and threaded at least partially into threaded aperture 30. This structure allows the jaws 16 to be attached together and allows the space between the jaws 16 to be adjusted by threading the connection member 32 further into the threaded aperture 30. This structure also provides a means in which to tighten the jaws 16 to the rail 58, thereby holding the sheath 12 in position. In FIG. 3, a slot 60 formed in the rail 58 is identified. As can be seen in the figure, it is one of a plurality of slots 60 formed transversely across the surface of the rail 58. The positioning of the apertures 28 and 30 can be arranged on jaws 16 such that the elongate connection member 32 can span between the jaws 16 while passing through one of the slots 60, such as the one identified in FIG. 3. In this way, the elongate connection member 32 can aid in holding the sheath 12 in position by preventing the movement of the sheath 12 in the elongate direction of the rail 58.

The sheath 12 includes a structure for carrying the replacement clip 52 including a dispensing port through which the replacement clip 52 is withdrawn. The mechanism for mounting is positioned wherein a replacement clip 62 carried within the sheath 12 is fully withdrawn generally along an axis 34 of the sheath 12, the clip 62 is oriented and located relative to the entry of the magazine well 54 to enable prompt insertion therein.

Figure 4:
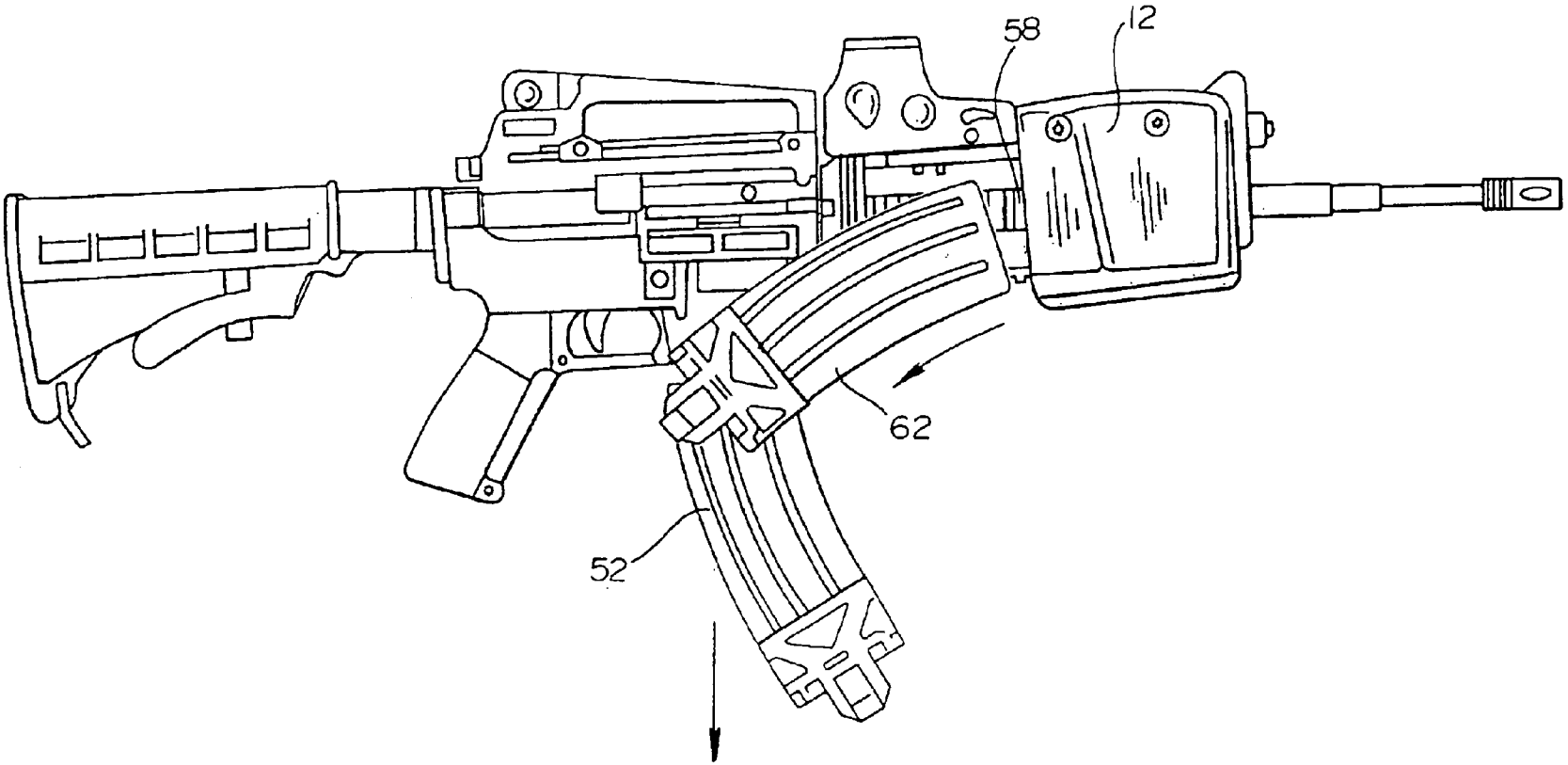
FIG. 4 is a right side view illustrating the first sequence of movement of the magazine clip and replacement clip.
Figure 5:
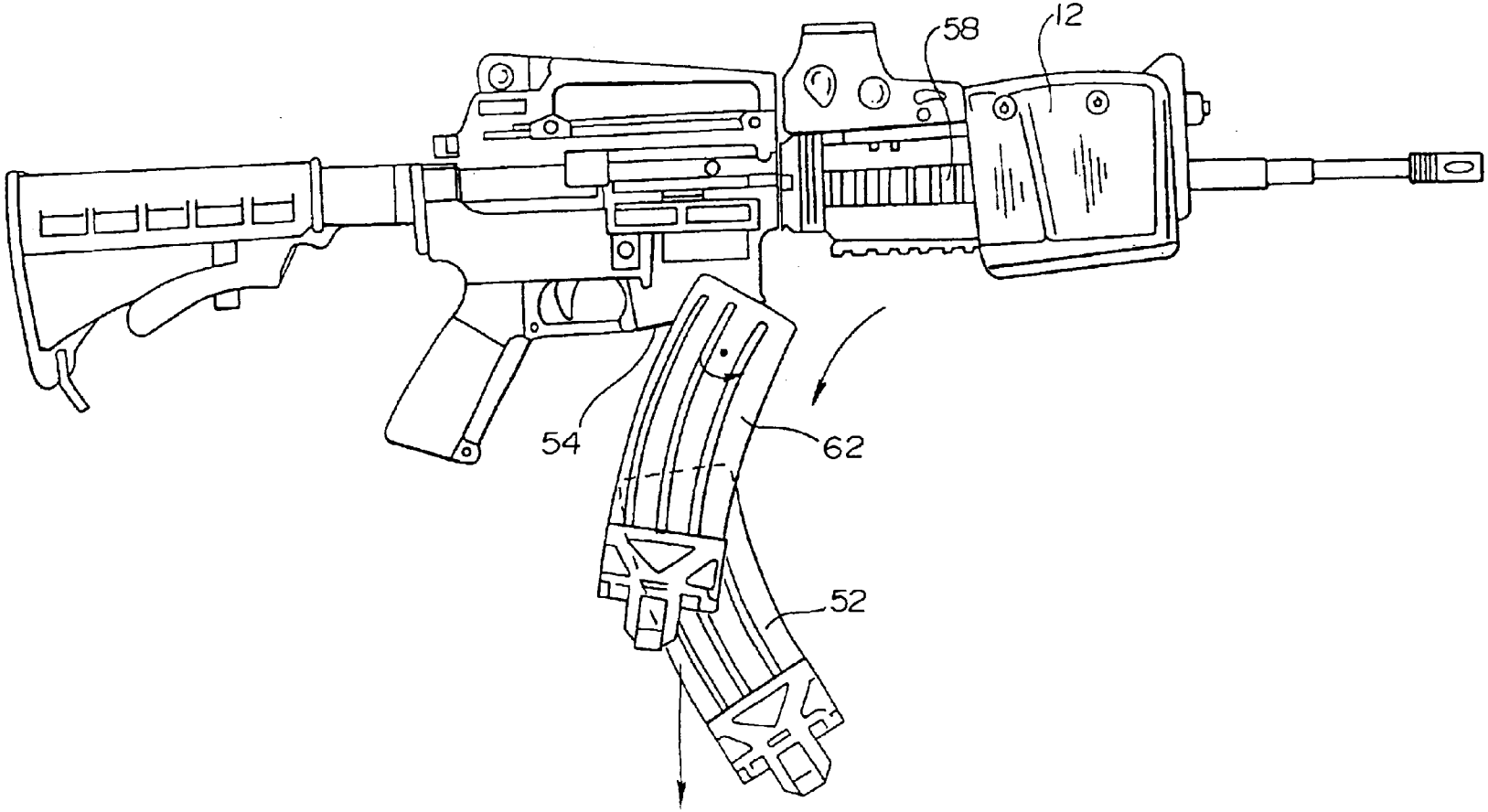
FIG. 5 is a right side view illustrating the second sequence of movement of the magazine clip and replacement clip.
Figure 6:
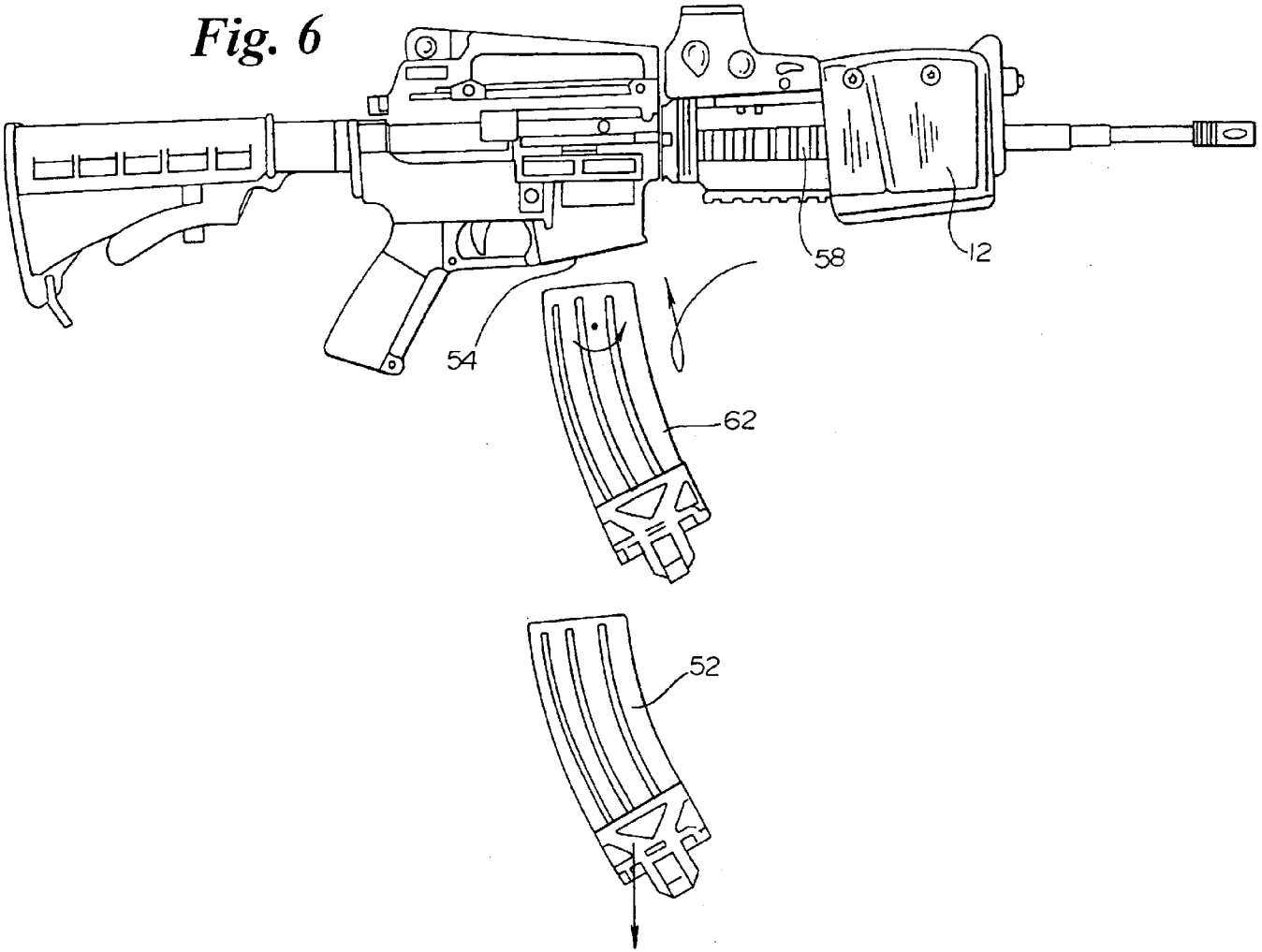
FIG. 6 is a right side view illustrating the third sequence of movement of the magazine clip and replacement clip.
Figure 7:
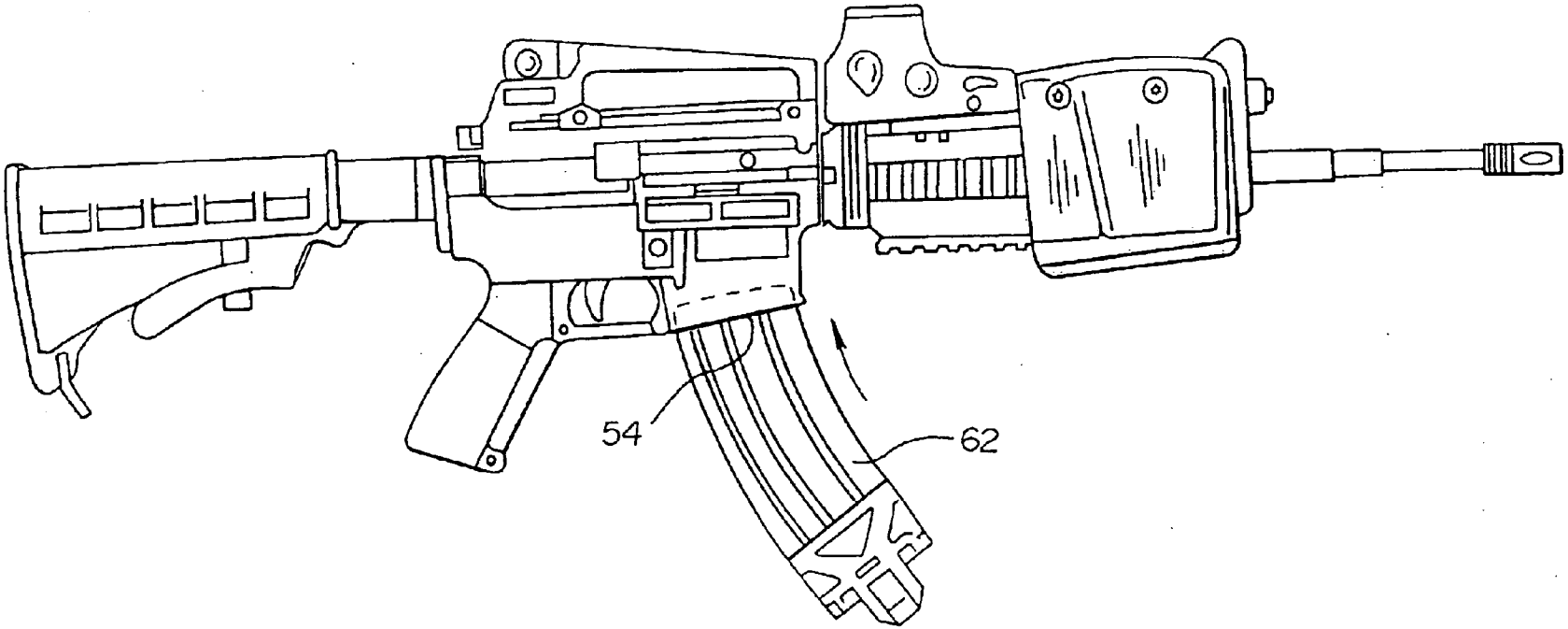
FIG. 7 is a right side view illustrating the fourth sequence of movement of the replacement clip.
Figure 8:
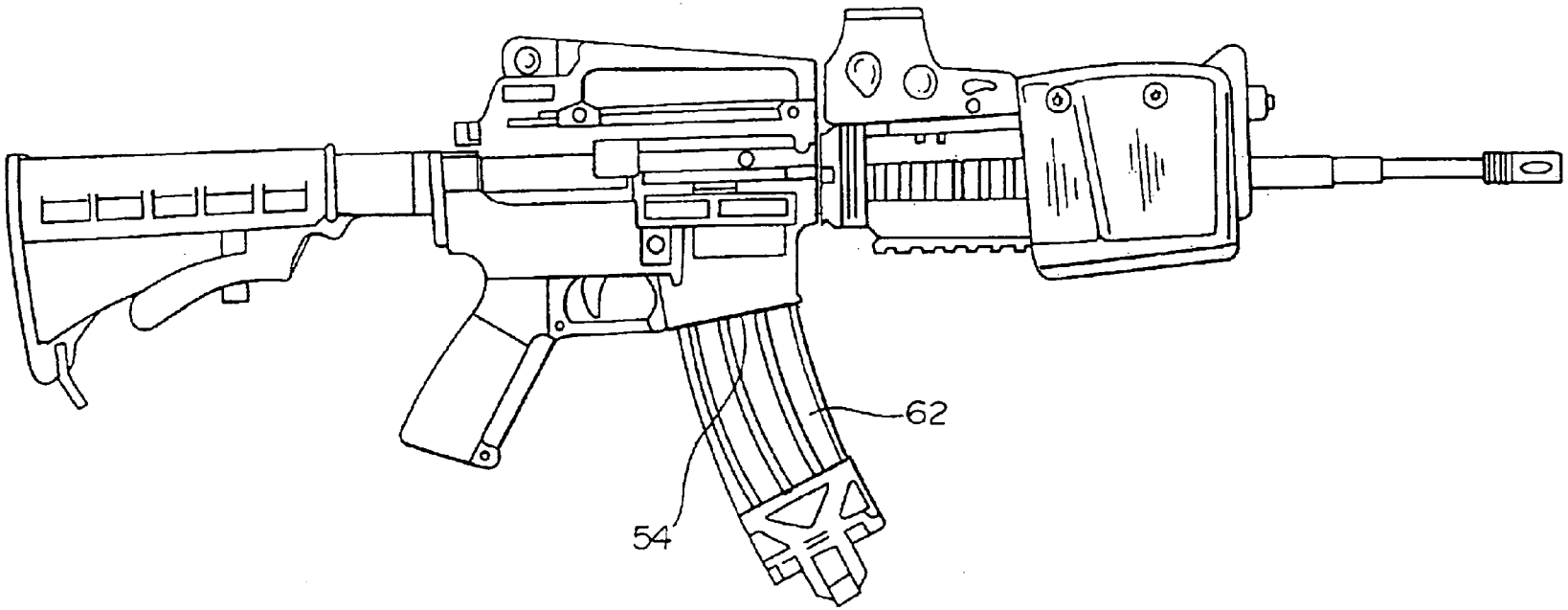
FIG. 8 is a right side view illustrating the fifth sequence of movement of the replacement clip.

FIGS. 4–8 illustrate the sequence of events and the movement of both the magazine clip 52 and the replacement clip 62. In FIG. 4 the sequence begins with the magazine clip 52 being expelled from the magazine well 54. On a weapon such as the one shown in the figures, the action of expelling the magazine clip 52 from the well 54 is accomplished by pressing a button on the weapon 50 that actuates a spring mechanism to eject the clip 52 from the well 54. This can be accomplished by using the hand holding the weapon 50 (firing hand). The other hand is used to withdraw the replacement clip 62 from the sheath 12. As can be seen from FIGS. 4–6, as the magazine clip 52 continues to fall from the magazine well 54, the movement of the replacement magazine 62 in an arcuate motion from the sheath 12 allows the replacement clip 62 to be positioned below the magazine well 54 for quick insertion into the weapon 50. Once positioned below the well 54, the user need only move the clip 62 upward and secure it within the well 54, as shown in FIGS. 7 and 8. Although depicted herein for use on a rifle, the sheath structure and positioning concepts may be applied on other weapons such as hand guns, and the like.

The above description is illustrative of the some embodiments and features of the present invention, however, it should not be construed to limit the language of the claims below.

That which is claimed is:

1. Apparatus for disposing an arcuate replacement clip for an automatic weapon, having a magazine well into which such a clip is to be received, for facile and expeditious insertion into the magazine well, comprising:

a sheath for carrying the replacement clip unobtrusively and forward of the magazine well, said sheath including a dispensing port through which the replacement clip is withdrawn along an extension of an axis defined by said sheath; and means for mounting said sheath to the automatic weapon in an orientation wherein said extension of said axis defined by said sheath intersects at an acute angle an extension of an axis defined by the magazine well, and wherein a replacement clip carried within said sheath, when fully withdrawn from said sheath generally along said extension of said axis thereof, is oriented and located on said extension of said axis defined by the magazine well and disposed relative to an entry to the magazine well to enable prompt insertion therein.

2. Apparatus in accordance with claim 1 wherein the automatic weapon is a rifle having an elongated barrel with a rail, and wherein said means for mounting said sheath to the automatic rifle comprises a clamp, carried by said sheath, for capturing the rail.

3. Apparatus in accordance with claim 2 wherein said clamp comprises a pair of jaws, adjustable toward and away from one another, to capture the rail.

4. Apparatus in accordance with claim 3 wherein the rail has an elongate axis and a plurality of slots are formed transversely on the rail and wherein an elongate connection member spans between said pair of jaws and is oriented within one of said slots.

5. Apparatus in accordance with claim 2 wherein said clamp has two interior end surfaces and the rail has two exterior end surfaces and wherein said two interior surfaces and two exterior surfaces contact each other.

6. Apparatus in accordance with claim 3 wherein said clamp has two parts and said parts are attached together by an elongate connection member.

7. Apparatus in accordance with claim 6 wherein said elongate connection member has a threaded exterior surface and wherein one said jaw has a threaded aperture formed therein and said other jaw has a non-threaded aperture therethrough and wherein said elongate connection member is placed through said non-threaded aperture and threaded into said threaded aperture.

8. Apparatus in accordance with claim 1 wherein said sheath has an interior surface sized to frictionally hold the replacement clip therein.

* * * * *